US006530335B1

(12) United States Patent
Halfmann et al.

(10) Patent No.: US 6,530,335 B1
(45) Date of Patent: Mar. 11, 2003

(54) PROGRAMMABLE SEWING SYSTEM HAVING FOLDING TOOL AND ELECTRONICALLY CONTROLLED PRESSURE PAD

(75) Inventors: Wilfried Halfmann, Kaiserslauten (DE); Andreas Rübel, Olsbrücken (DE); Bernd Maue, Kreimbach-Kaulbach (DE)

(73) Assignee: G.M. Pfaff Aktiengesellschaft in Insolvenz (DE)

( * ) Notice: Subject to any disclaimer, the term of this patent is extended or adjusted under 35 U.S.C. 154(b) by 0 days.

(21) Appl. No.: 10/048,145

(22) PCT Filed: Apr. 27, 2001

(86) PCT No.: PCT/EP01/04759

§ 371 (c)(1),
(2), (4) Date: Jan. 23, 2002

(87) PCT Pub. No.: WO01/90467

PCT Pub. Date: Nov. 29, 2001

(30) Foreign Application Priority Data

May 24, 2000 (DE) ..... 100 25 633

(51) Int. Cl.[7] ..... D05B 21/00; D05B 27/00; D05B 35/08

(52) U.S. Cl. ..... 112/470.16; 112/147; 112/320

(58) Field of Search ..... 112/470.16, 470.06, 112/147, 141, 143, 2, 311, 320

(56) References Cited

U.S. PATENT DOCUMENTS

| | | | | |
|---|---|---|---|---|
| 3,669,048 A | * | 6/1972 | Dunn et al. | 112/320 X |
| 4,418,629 A | | 12/1983 | Mall et al. | |
| 4,517,907 A | * | 5/1985 | Franke, Sr. | 112/470.16 |
| 5,065,684 A | * | 11/1991 | Hansberry | 112/470.06 X |
| 5,730,076 A | | 3/1998 | Ruebel et al. | |

FOREIGN PATENT DOCUMENTS

| | | |
|---|---|---|
| DE | 16 60 839 | 9/1967 |
| DE | 71 16 976 | 5/1971 |
| DE | CH 642 412 A | 7/1979 |

* cited by examiner

*Primary Examiner*—Peter Nerbun
(74) *Attorney, Agent, or Firm*—McGlew and Tuttle, P.C.

(57) ABSTRACT

A sewing device (1) is provided with a programmable electronic control system (4) for sewing folds and tucks. Such that format-dependent parts (guide tongue, pressure pad) can be eliminated at the time of a change of the seam program the use of a guide tongue is eliminated that depends on the form of the seam and of a format-dependent pressure pad. The feed of the fabric is performed only with a folding tool (5) with straight folding edge and the holding and guiding of the fabric during the sewing operation using a straight pressure pad (7). The electronic control system (4) can be programmed such that the desired seam course is obtained exclusively by the superimposition of longitudinal and transverse movements of the pressure pad (7). Parameters (1'–7$^{IV}$) that determine the seam course are preferably entered in a graphics-supported manner.

13 Claims, 6 Drawing Sheets

FIG.2
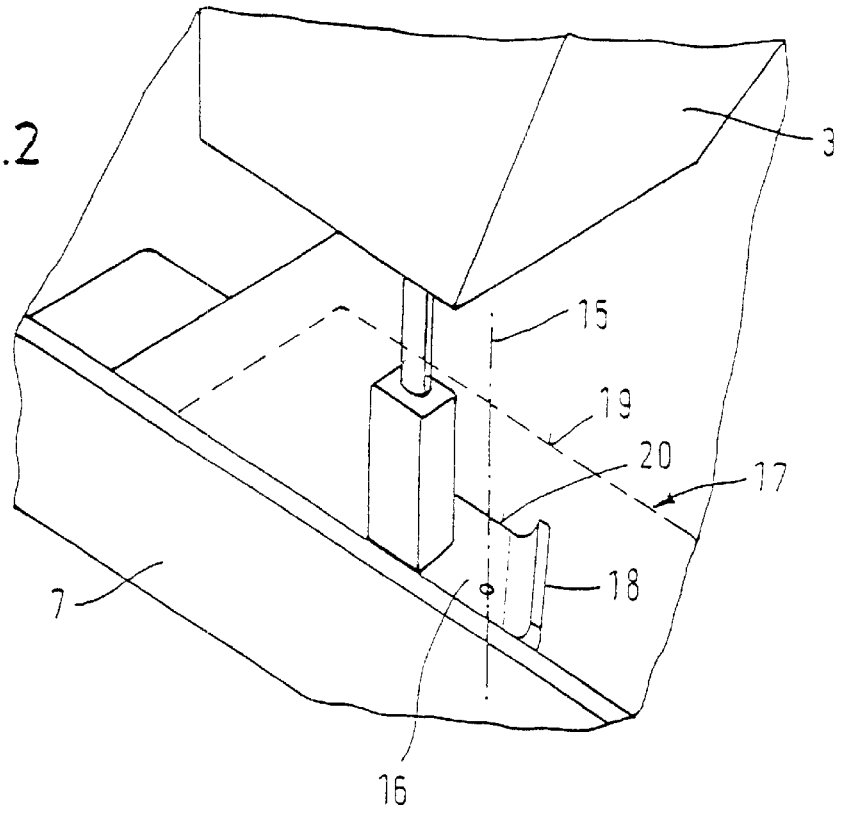
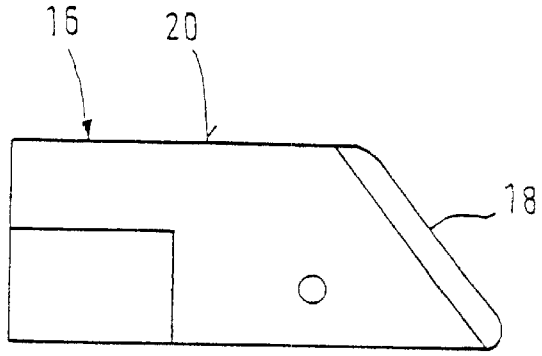
FIG.3
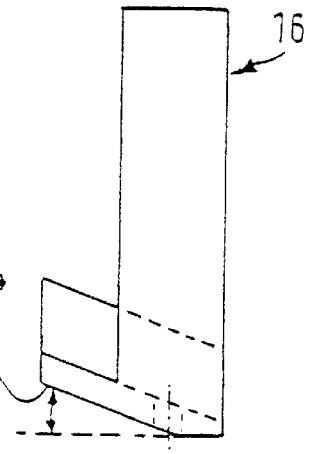
FIG.4

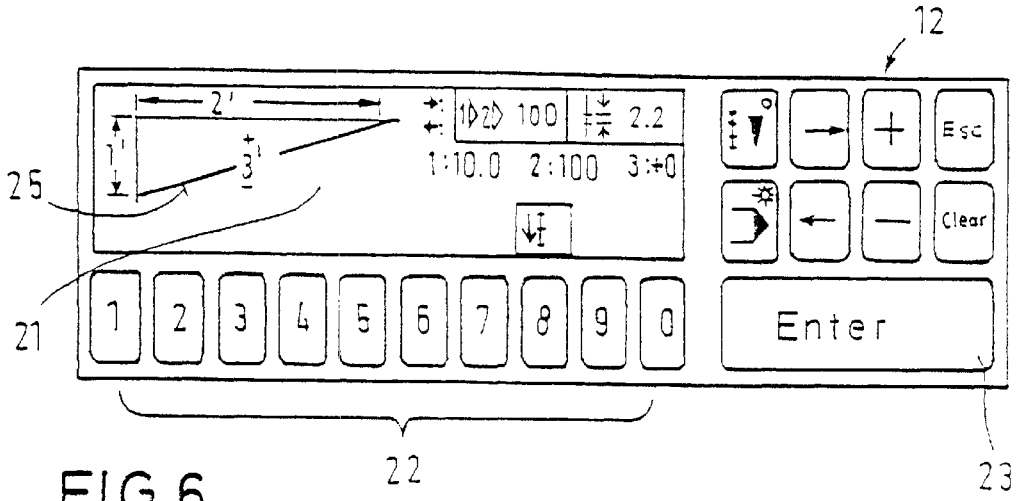
FIG.6
FIG.7
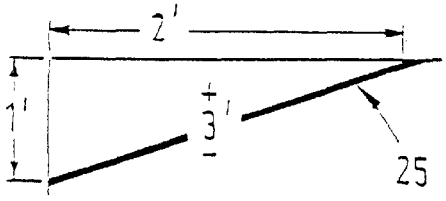
FIG.8
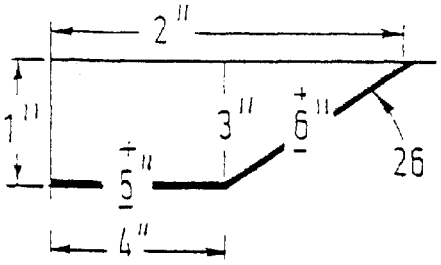
FIG.9
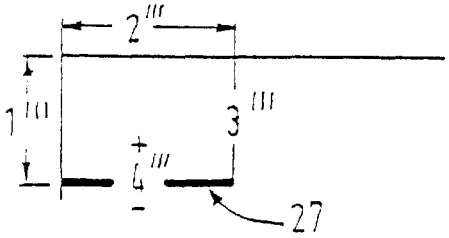
FIG.10
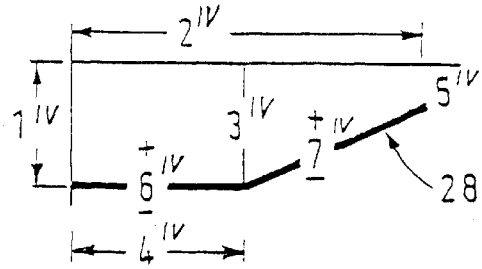

PROGRAMMABLE SEWING SYSTEM HAVING FOLDING TOOL AND ELECTRONICALLY CONTROLLED PRESSURE PAD

FIELD OF THE INVENTION

The present invention pertains to a sewing device with a programmable electronic control system for sewing folds and tucks.

BACKGROUND OF THE INVENTION

In prior-art sewing devices of this type, the fabric being sewn is usually first delivered into a transfer position by a folding tool, which is provided on the front side with a replaceable guide tongue that is adapted to the course of the seam to be sewn where it is temporarily fixed in that position and subsequently held by a pressure pad by lowering this pressure pad. The feed of the fabric being sewn is subsequently performed by the pressure pad, which is displaced in the longitudinal direction as well as in the transverse direction and is likewise adapted in terms of its shape to the course of the seam. The sewing is performed along and as close to the pressure pad as possible, so that the pressure pad can be moved only away from the sewing needle to the outside during a transverse displacement movement.

The drawback of these prior-art sewing devices is, among other things, that not only the corresponding seam program, but also the parts whose shape depends on the course of the particular seam (pressure pad and guide tongue) must be replaced when changing the desired course of the seam. In addition, additional mechanical settings must be performed in case of a change in the fabric thickness, because the distance between the sewing needle and the folded edge of the fabric depends on the fabric thickness in the prior-art devices.

DE-GM 71 16 976 discloses a sewing device with a template rail driven in its longitudinal direction, which comprises a pressure pad for the fabric and a guide strip, which is continuously in contact with a guide means accommodated by a carrier in order to perform the movements which are directed sideways depending on the shape of the guide strip and which movements are superimposed to the longitudinal movement.

Therefore, not only the corresponding seam program but also the parts whose shape depends on the course of the particular seam (guide strip) must be replaced in case of a change in the desired course of the seam in this prior-art device as well.

This also applies to the sewing devices known from the documents DE 42 34 968 C1 and DE 40 31 200 A1 with a fabric holder driven in the longitudinal and transverse directions. These fabric holders, which are used to sew on pockets, have a sewing slot corresponding to the shape of the seam. Since the fabric holder grasps the pocket on both sides of the sewing slot it is carried without warping in unchanged aligned position in each transport direction.

When preparing tucks, in which the seam always ends at an acute angle at the folded edge of the fabric, the edge must be exposed. It is therefore not possible to use fabric holders which surround the seam to be formed for holding and guiding fabric that is to be provided with tucks.

Furthermore, a sewing unit for preparing tucks, which contains a folding tool movable between a receiving position and a transfer position for the fabric, an elastic folding aid plate, holding means in the form of a needle bar for the folded tuck, and a pressing rail for taking over the folded fabric and for guiding during the sewing operation, has been known from DE-PS 16 60 839. The angular position of the folding tool in relation to the pressing rail is adjustable in order to obtain a certain tuck depth. The folding tool pushes through the fabric during its forward movement under the elastic folding aid plate and the raised pressing rail to the extent that the tuck protrudes on the rear side of the pressing rail, doing so depending on the preselected angular position of the folding tool, i.e., corresponding to the desired tuck depth. At the end of the forward movement of the folding tool, the needle bar is moved downward, and its needles grasp the fabric in the area of the fold and fix it on a sewing table plate.

However, this document contains no reference to any means that determine the end of the feed motion of the folding tool, whether, e.g., any stops or the end point of the feed path of the drive means for the folding tool. The accurate setting of the end of the feed motion is of great significance, because the intersection of the tuck seam with the folded edge of the fabric is determined by the position or the distance of the end point of the feed motion of the folding tool from the needle of the sewing machine. The desired high-quality sewing result is obtained only if the end stitches of the seam, which are shortened for the purpose of securing the seam, have the required distance from the folded edge of the fabric. If the distance is too great, the tuck forms a rather unattractive, funnel-shaped depression instead of a sharp tip. If, by contrast, the distance is too short, the length of the tuck will be too short and some of the shortened end stitches fall into the free area, as a consequence of which the seam will not be sufficiently secured.

German patent application DE 100 11 162.9 discloses a sewing device with a sewing machine, a folding tool that can be moved between a receiving position and a transfer position for the fabric and a pressure pad for taking over the folded fabric and for guiding the fabric during the sewing operation, in sewing device stop means are provided for limiting the feed motion of the folding tool in the transfer position, and these stop means are located in the path of movement of the part of the folding edge of the folding tool that is surrounded by the folded fabric. It is achieved by means of the stop means arranged in this manner that the outside of the folded edge of the fabric will always have the same distance from the sewing needle in case of unchanged position of the stop means in case of thin and thick fabrics alike. However, regardless of the particular fabric thickness and without any corrective measures, the actual intersection, e.g., of a tuck seam, with the outside of the folded edge of the fabric always exactly coincides with the desired intersection.

SUMMARY OF THE INVENTION

The basic object of the present invention is to propose a sewing device of the type mentioned in the introduction, in which it is not necessary to change shape-dependent parts (guide tongue, pressure pad) in case of a change of the seam program and in which additional mechanical settings are not necessary despite a change in the fabric thickness.

According to the invention, a sewing device is provided with a programmable electronic control system for sewing folds and tucks. The sewing device comprises a sewing machine with a sewing needle and with a holding-down device and with a folding tool. The folding tool can be moved between a receiving position and a transfer position for the fabric. A stop is provided for limiting the feed motion of the folding tool in the transfer position. A holder is provided for the fold or tuck formed. A pressure pad is provided for taking over the folded fabric in the transfer position and for guiding the fabric during the sewing operation. The pressure pad has a straight design independently from the seam format. To obtain a flat sewing field, the pressure pad is arranged movably in the longitudinal direction by a first drive connected to the control system and in the transverse direction by a second drive connected to the control system. The control system can be programmed such that the particular desired seam course can be obtained exclusively by the superimposition of the longitudinal and transverse movements of the pressure pad. Both movements away from the sewing needle and movements toward the sewing needle are possible. The holding-down device is designed as a floating foot that holds the fabric flat at least in the area of the sewing needle.

The present invention is based on a device of the type described in DE 100 11 162.9 and it makes do without the use of a guide tongue that depends on the shape of the seam as well as of a shape-dependent pressure pad. The fabric is rather fed only with a folding tool with a straight folding edge and the fabric is held and guided during the sewing operation by means of a straight pressure pad, and the electronic control system is programmed such that the desired course of the seam is obtained exclusively by the superimposition of longitudinal and transverse movements of the pressure pad.

To make it possible to sew the largest possible number of different seam courses with the sewing device according to the present invention, it proved to be advantageous not to sew directly at the pressure pad but to select a greater mean distance between the sewing needle and the pressure pad than in prior-art devices, so that the pressure pad can perform both movements to the outside and toward the sewing needle. To avoid the problems that can possibly occur during the pulling out of the sewing needle, a holding-down device designed as a floating foot, which is located at a short distance above the folded edge of the fabric and holds the fabric during the pulling out of the needle and during the tightening of the thread knot without otherwise touching it is arranged in the area of the sewing needle.

To substantially shorten the changeover times of the sewing device even further during a change of the seam program, provisions are made in a preferred embodiment of the present invention for the seam parameters to be programmable in a graphics-supported manner. The sewing device contains for this purpose a display screen, which is electrically connected to the control system and on which the particular desired geometric seam course can be displayed. In addition, preferably standard seam programs are stored in the control system. In case of a change of a seam program, the particular new seam program is called up by depressing a corresponding key and the course of the seam is displayed on the display screen. If parameters of the seam program are to be changed, the corresponding new parameters are entered via a keyboard connected to the control system. All parameters of a seam course are defined now as length measurements.

To prevent the fabric from bulging out in the axial and radial directions, it proved to be advantageous for the floating foot to have both an opening, wedge-shaped course on its side facing the folded edge of the fabric and a course decreasing obliquely to the folded edge of the fabric on its front side opposite the direction of movement of the fabric.

In another embodiment of the present invention, the holding-down device is not fastened on the sewing machine of the sewing device according to the present invention, but on a part that also participates in the transverse movements of the pressure pad. The roller carrier of the drive displacing the pressure pad at right angles to the longitudinal direction has proved to be particularly suitable as such a part. Due to the joint movement of the holding-down device in the transverse direction, it can be designed as a holding-down device having such a large area that it covers the fabric area between the pressure pad and the edge of the fabric during the entire sewing operation and holds it flat as a result. Bulges which may frequently occur in the case of a holding-down device fastened to the sewing machine especially near the end of the given sewing operation due to the great distance existing between the holding-down device and the pressure pad are therefore eliminated in this case.

Provisions are made in another embodiment of the present invention for arranging a pressing finger, whose underside is flush with the underside of the pressure pad and which is offset transversely, at the pressure pad for the distortion-free transport of the fabric. The pressing finger preferably has a wedge-shaped cross section, so that the holding-down device seated on the pressing finger at the beginning of the sewing operation slides off from the pressing finger without a jerk as the sewing progresses.

Further details and advantages of the present invention appear from the following exemplary embodiments explained on the basis of figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 2 is an enlarged view of the sewing device shown in FIG. 1 in the area of the holding-down device with the fabric indicated by broken line;

FIG. 3 is a top view of the holding-down device shown in FIG. 2;

FIG. 4 is a side view of the holding-down device shown in FIG. 2;

FIG. 6 is a front view of the keyboard and display screen unit with a graphically displayed seam program;

FIG. 7 is a view of a standard seam program on the display screen;

FIG. 8 is a view of another standard seam program on the display screen;

FIG. 9 is a view of another standard seam program on the display screen;

FIG. 10 is a view of another standard seam program on the display screen;

DESCRIPTION OF THE PREFERRED EMBODIMENT

Figure 1:
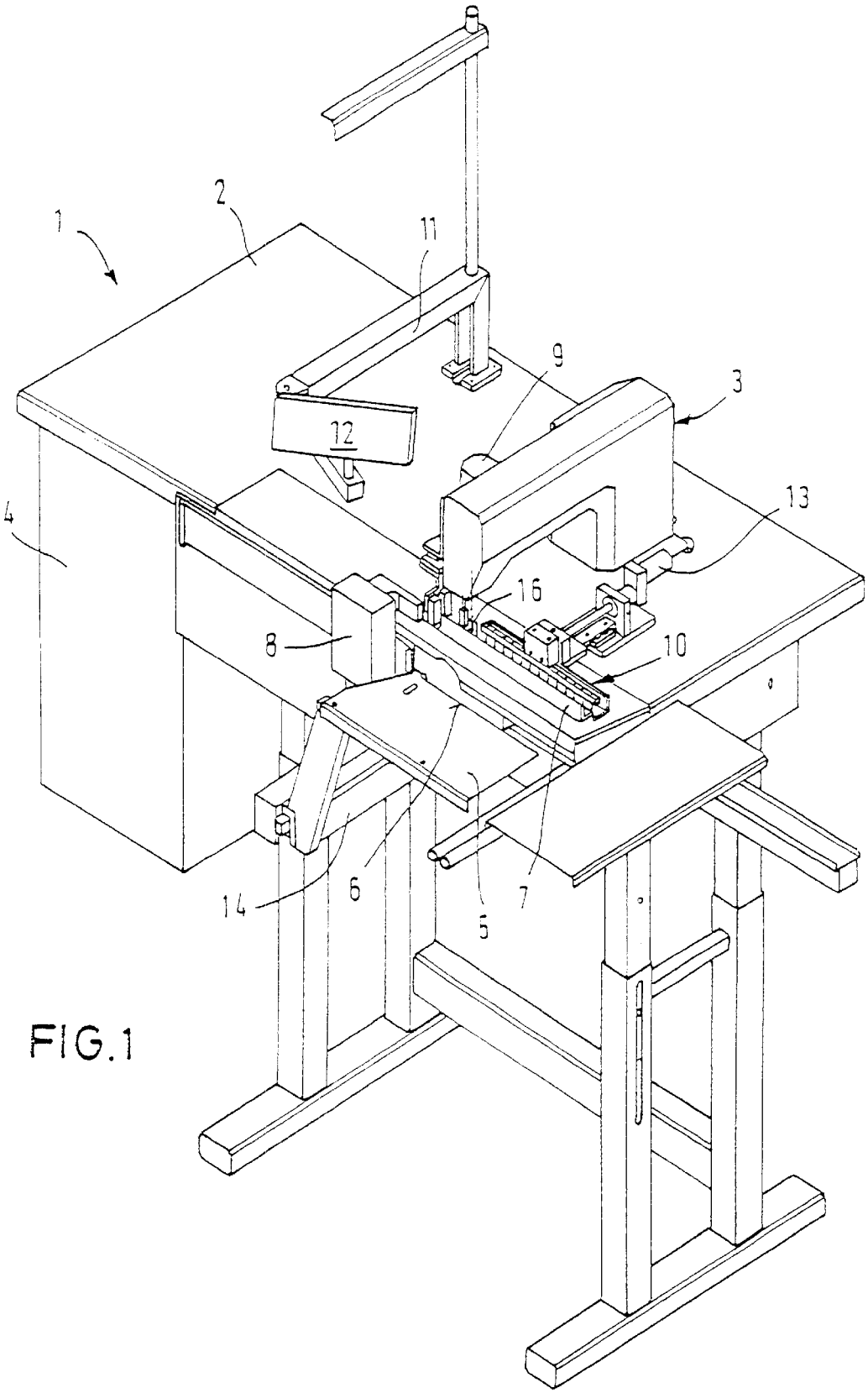
FIG. 1 is a perspective view of a sewing device according to the present invention with a sewing machine, on which a holding-down device is fastened, and with a keyboard and display screen unit.

Referring to the drawings in particular, a sewing device for sewing folds and tucks with an electric sewing machine 3 arranged on a table 2 and with a programmable electronic control system 4 is designated by 1 in FIG. 1. Furthermore, a folding tool 5 with straight folding edge 6, which is arranged displaceably from a receiving position into a transfer position for the fabric, is arranged at the table 2. Furthermore, a straight pressure pad 7 for holding and guiding the fabric during the sewing operation, which can be moved in the longitudinal and transverse directions by means of corresponding drives 8, 9, is located at the table 2.

The sewing device 1 also includes a holding means 10 with stop means for limiting the feed motion of the folding tool 5 in the transfer position and for the temporary fixation of the fabric provided with the fold as well as a display screen-keyboard unit 12 arranged on a swivel arm 11.

Figure 5:
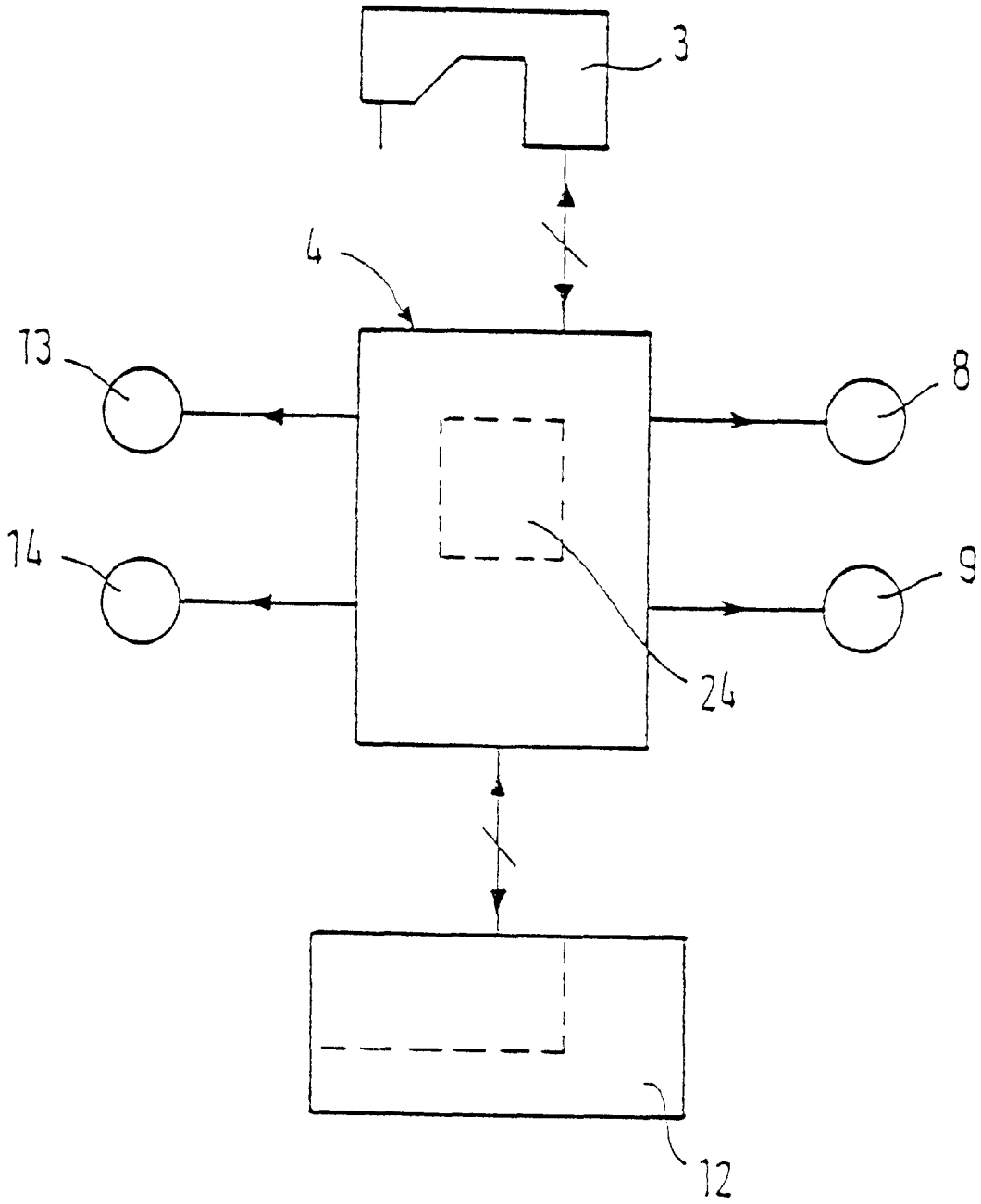
FIG. 5 is a schematic block diagram of the electronic control system with the keyboard and display screen unit connected.
Figure 11:
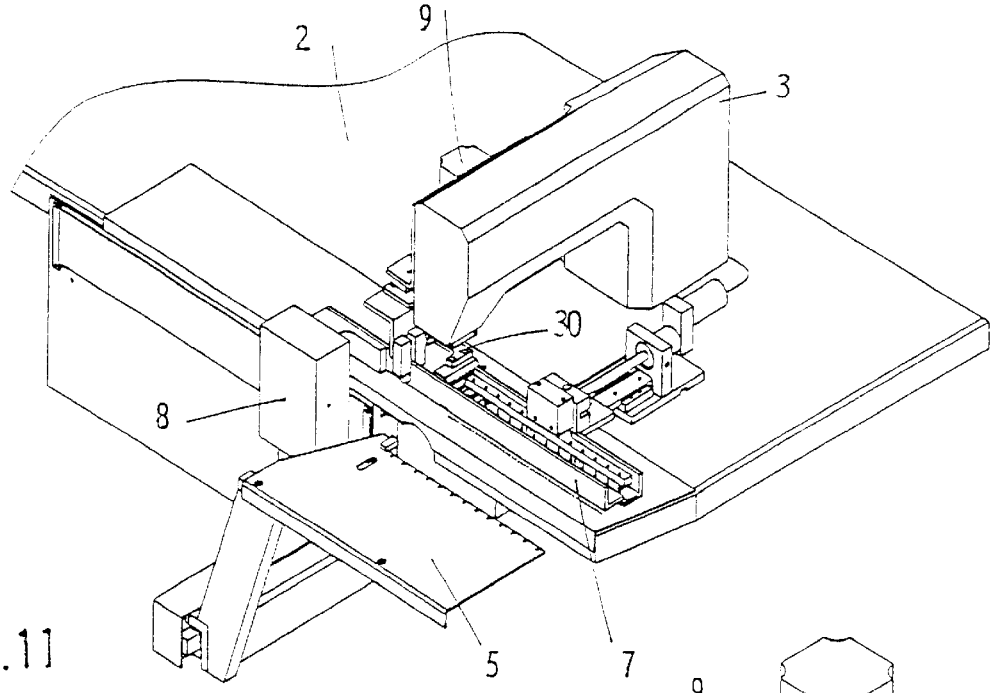
FIG. 11 is a perspective view of a second exemplary embodiment of the sewing device according to the present invention.

The electric sewing machine 3, the display screen-keyboard unit 12, the drives 8, 9 for the pressure pad 7 as well as the drives 13, 14 for the holding means 10 and the folding tool 5 are electrically connected to the control system 4 (FIG. 5). The design of the display screen-keyboard unit 12 is shown in FIG. 6. The keys shown are so-called soft keys.

A holding-down device 16 designed as a floating foot, whose connection to the sewing machine 3 is not shown specifically for clarity's sake, is fastened to the sewing machine 3 in the area of the sewing needle 15, which is indicated by a dash-dotted line only (FIG. 2). To prevent bulges of the fabric 17 indicated by broken line from being formed during sewing in the axial and radial directions, the floating foot 16 has both an oblique course decreasing to the folded edge 19 of the fabric on its front side 18 located opposite the direction of movement of the fabric 17 (FIG. 3) and an opening, wedge-shaped course on its side 20 facing the folded edge 19 of the fabric 17 (FIG. 4).

The mode of operation of the sewing device according to the present invention will be explained in greater detail below. Regardless of the desired course of the seam, the fabric is first displaced in the known manner from a receiving position into a transfer position while forming the desired fold by means of the folding tool 5 and is fixed in that position by means of the holding means 10 by lowering holding needles. The folding tool 5 subsequently moves back into its receiving position. The pressure pad 7 lowers onto the fabric and now holds the fabric, while the holding needles are displaced upward and release the fabric.

The desired seam program (e.g., for a tuck) can now be set unless it had been set already. To do so, e.g., the seam course shown in FIG. 7, which is designated by 25, is set. This seam course will then appear graphically on the display screen 21 of the display screen-keyboard unit 12. By depressing the number keys 22, the parameters of the course of the seam can be changed. The variable values are the tuck depth 1', the tuck length 2' and the curvature 3'. In addition, more values such as the program number, the stitch length, seam additions, etc., can be entered by means of the keyboard and displayed on the display screen 21. After depressing the "enter" key 23, the programmed values are taken over into a corresponding memory 24 of the control system 4 (FIG. 5) and the sewing operation is initiated. After the conclusion of the sewing operation, the pressure pad 7 releases the fabric 17 and returns into its starting position, so that a new fabric can be fed in by means of the folding tool 5.

It was found that the majority of the tucks and pleats occurring in practice can be programmed with the four basic forms shown in FIGS. 7–10.

FIG. 8 shows the seam course 26 of another tuck. The variable values are the tuck depth 1", the tuck length 2", the waist depth 3", the waist length 4", the first curvature 5", and the second curvature 6" in this case.

FIG. 9 shows the seam course 27 of a pleat with variable first pleat depth 1''', the pleat length 2''', the second pleat depth 3''', and the curvature 4'''.

FIG. 10 also shows the seam course 28 of a pleat with variable first pleat depth $\mathbf{1}^{IV}$, a first pleat length $\mathbf{2}^{IV}$, a second pleat depth $\mathbf{3}^{IV}$, a second pleat length $\mathbf{4}^{IV}$, a third pleat depth $\mathbf{5}^{IV}$, a first curvature $\mathbf{6}^{IV}$, and a second curvature $\mathbf{7}^{IV}$.

After entering all the values intended for the given seam course the control system performs a plausibility check of the data. Should they lead to an unacceptable seam, the value entered incorrectly is displayed on the display screen-keyboard unit 12.

Other, unusual seam forms can be obtained by free programming. Any desired seam course is possible in the sewing field in which the sewing device can move (e.g., 250×30 mm).

The present invention is by no means limited to the above-described exemplary embodiment. For example, FIGS. 11–15 show an exemplary embodiment in which a holding-down device 30 that is fastened to a roller carrier 31 rather than to the sewing machine 3 is provided. This roller carrier in turn guides the pressure pad designated by 7 and is connected to the second drive 9, so that it participates in the transverse movements of the pressure pad 7. Due to this joint movement of the holding-down device 30 in the transverse direction, it can have such a large area that it covers the sewing field 32 between the pressure pad 7 and the folded edge 19 of the fabric 17 (FIG. 13) during the entire sewing operation and holds it flat as a result.

The effect caused by the longitudinal movement of the pressure pad 7, according to which a moment that facilitates the upward bulging of the fabric acts in the fabric, is therefore considerably less noticeable in the case of the large-area holding-down device 30 than in case of the use of the holding-down device 16 described in connection with FIGS. 1 and 2.

Figure 12:
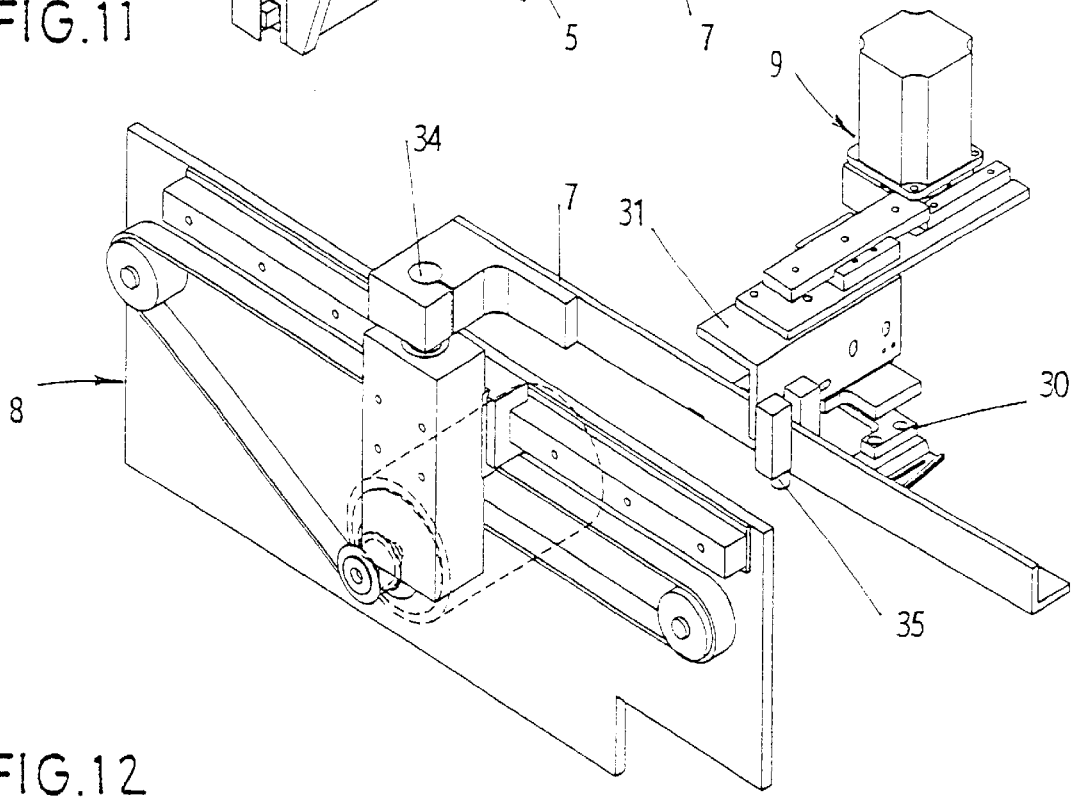
FIG. 12 is an enlarged perspective view of the drives of the pressure pad of the sewing device shown in FIG. 11 with the pressure pad and the holding-down device.
Figure 13:
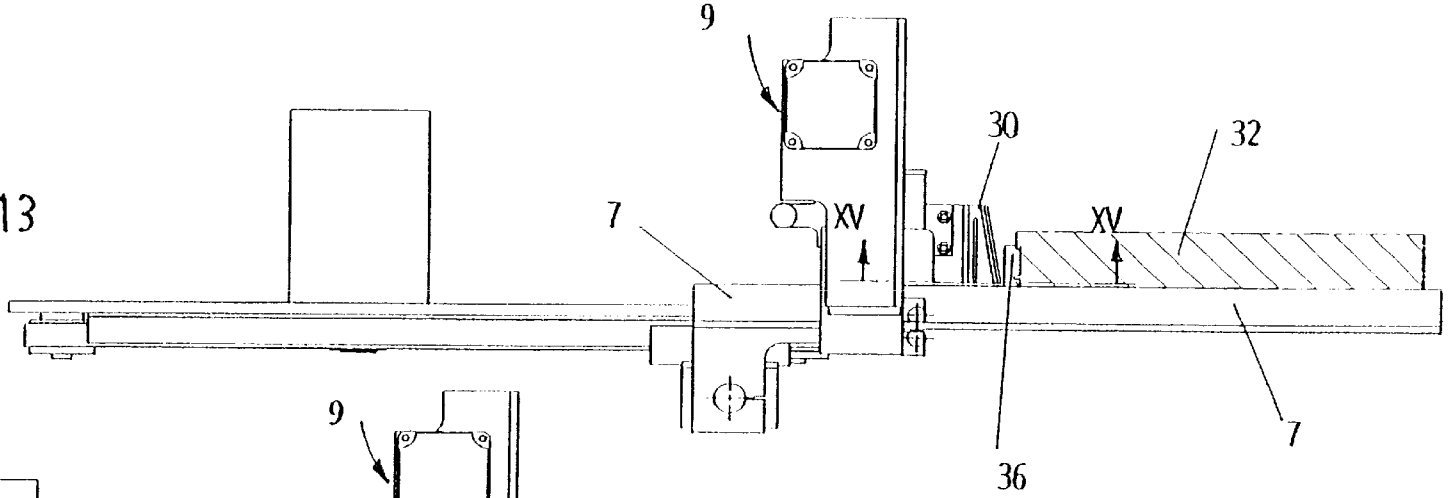
FIG. 13 is a top view of the drive arrangement shown in FIG. 12 in a lateral position of the pressure pad.

The corresponding arrangement of the holding-down device 30 at the roller carrier 31 appears especially from FIG. 12. The pressure pad 7 is arranged laterally pivotably around an axis of rotation 34 that is displaceable in the longitudinal direction by the drive 8, and the lateral pivoting movement takes place by means of the second drive 9 to obtain the flat sewing field 32 (FIG. 13). This drive 9 acts via the roller carrier 31 with the rollers 35 on the pressure pad 7, which is guided between the rollers 35 in the longitudinal direction, on the one hand, and can be pivoted at right angles to the longitudinal direction, on the other hand.

Figure 14:
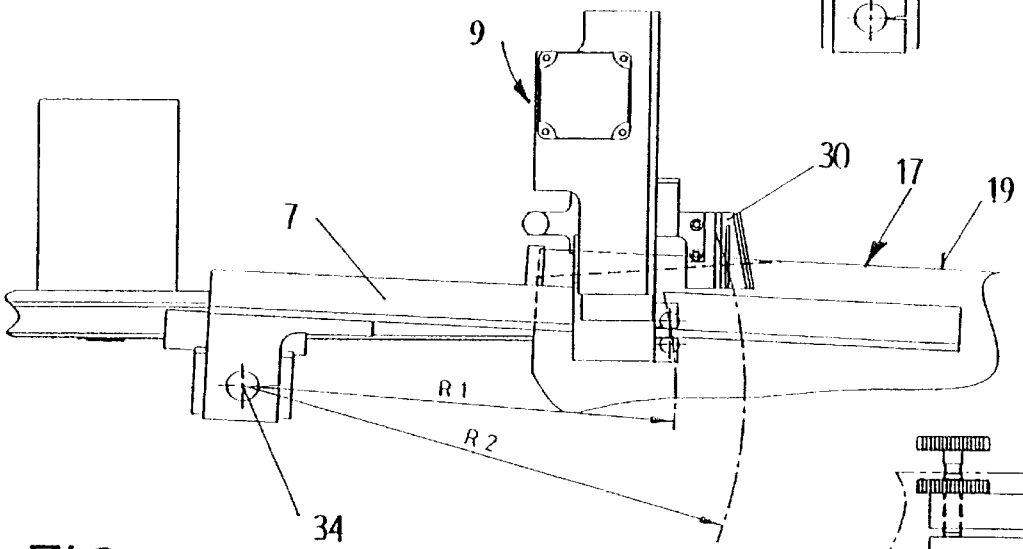
FIG. 14 is another top view of the drive arrangement shown in FIG. 12 in another lateral position of the pressure pad.

The special effect visible in FIG. 14 that the very small distance existing between the pressure pad 7 and the holding-down device 30 at the beginning of the sewing operation increases markedly in the course of the sewing operation because of the different radial distances R1 and R2 between the axis of rotation 34, on the one hand, and the rollers 35, on the other hand, but without appreciably exposing the corresponding area of the fabric, arises in conjunction with the rotatably movable mounting of the pressure pad. In the same manner as in the case of the holding-down device 16 shown in FIGS. 1 and 2, the increase in the distance generates a pulling force directed at right angles. Even though this pulling force is markedly weaker than that occurring in case of the use of the holding-down device 16, it is nevertheless capable of exerting a noticeable smoothing effect, because the bulges of the fabric are considerably flatter under the holding-down device 30 than are the bulges that can be formed between the holding-down device 16 and the pressure pad 7.

A transversely projecting, relatively short pressing finger 36, whose underside is flush with the underside of the pressure pad 7, makes a further contribution to the distortion-free transport of the fabric. As is apparent from FIG. 13, the pressure pad 7 and the pressing finger 36 surround the sewing field 32 in an L-shaped manner.

Figure 15:
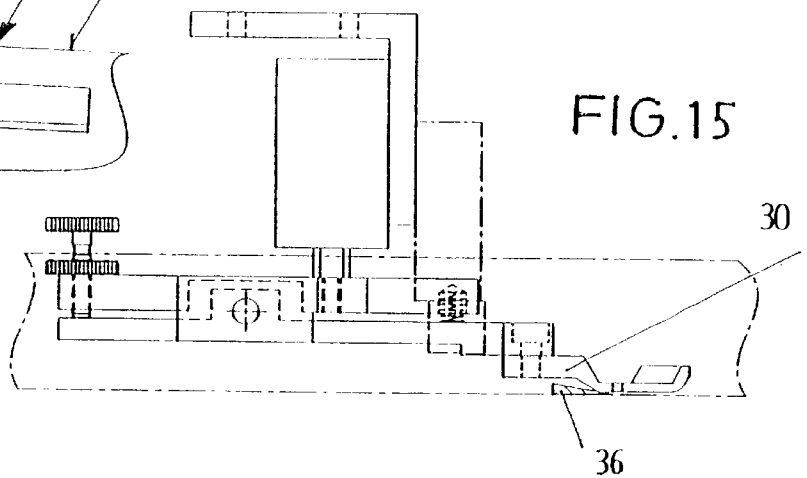
FIG. 15 is a section through the arrangement shown in FIG. 13 along the section line indicated by line XV—XV there.

The pressing finger 36 has a wedge-shaped cross section (FIG. 15). As a result, the holding-down device 30 seated on the pressing finger 36 at the beginning of the sewing operation can slide off from the pressing finger 36 without a jerk as the sewing progresses.

While specific embodiments of the invention have been shown and described in detail to illustrate the application of the principles of the invention, it will be understood that the invention may be embodied otherwise without departing from such principles.

What is claimed is:

1. A sewing device with a programmable electronic control system for sewing folds and tucks, the sewing device comprising:

a sewing machine with a sewing needle;

a holding-down device;

a folding tool movable between a receiving position and a fabric transfer position;

a stop for limiting the feed motion of the folding tool in the transfer position;

a fold holder for the fold or tuck formed;

a pressure pad for taking over the folded fabric in the transfer position and for guiding the fabric during the sewing operation, the pressure pad having a straight form, independent from the seam format;

a first drive connected to the control system for moving the pressure pad in the longitudinal direction and a second drive connected to the control system for moving the pressure pad in the transverse direction to obtain a flat sewing field;

the control system being programmed such that the particular desired seam course can be obtained exclusively by the superimposition of the longitudinal and transverse movements of the pressure pad, wherein both movements away from the sewing needle and movements toward the sewing needle are possible, the holding-down device being designed as a floating foot that holds the fabric flat at least in the area of the sewing needle.

2. A sewing device in accordance with claim 1, wherein the pressure pad is arranged laterally pivotably around an axis of rotation that can be displaced in the longitudinal direction by the first drive, so that the pressure pad is displaced laterally during its movement in the longitudinal direction by the second drive to obtain the flat sewing field.

3. A sewing device in accordance with claim 1, wherein the holding-down device is arranged at a part that also participates in the transverse movement of the pressure pad.

4. A sewing device in accordance with claim 3, wherein the second drive is connected to a roller carrier with rollers guiding the pressure pad, and the holding-down device is fastened to the roller carrier.

5. A sewing device in accordance with claim 3, wherein the width of the holding-down device is selected to be such that it approximately covers the entire area between the pressure pad and the folded edge of the fabric during the sewing operation.

6. A sewing device in accordance with claim 1, wherein the holding-down device is fastened to the sewing machine.

7. A sewing device in accordance with claim 1, wherein the floating foot has an opening, wedge-shaped course on its side facing the folded edge of the fabric.

8. A sewing device in accordance with claim 1, wherein the floating foot has an oblique course decreasing toward the folded edge of the fabric on its front side located opposite the direction of movement of the fabric.

9. A sewing device in accordance claim 1, wherein a transversely projecting pressing finger with an underside flush with the underside of the pressure pad, is arranged at the pressure pad.

10. A sewing device in accordance with claim 9, wherein the pressing finger has a wedge-shaped cross section, such that the holding-down device seated on the pressing finger at the beginning of the sewing operation slides off from the pressing finger without a jerk as the sewing progresses.

11. A sewing device in accordance with claim 1, wherein the sewing device includes a display screen, which is connected to the control system and on which the particular desired geometric seam course can be displayed.

12. A sewing device in accordance with claim 11, wherein standard seam programs each having a seam course can be displayed on the display screen, the standard seam programs being stored in the control system, parameters associated with the particular seam course being changed by means of a corresponding keyboard.

13. A sewing device in accordance with claim 11, wherein all parameters of a seam course are defined as length measurements.

* * * * *